US009303962B1

(12) United States Patent
Burnworth et al.

(10) Patent No.: US 9,303,962 B1
(45) Date of Patent: Apr. 5, 2016

(54) EXPANDING BROADHEAD

(71) Applicants: James R. Burnworth, Spokane, WA (US); Dorge O. Huang, Henry, IL (US)

(72) Inventors: James R. Burnworth, Spokane, WA (US); Dorge O. Huang, Henry, IL (US)

( * ) Notice: Subject to any disclaimer, the term of this patent is extended or adjusted under 35 U.S.C. 154(b) by 0 days.

(21) Appl. No.: 14/844,035

(22) Filed: Sep. 3, 2015

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,090,709 A 2/1992 Johnson
5,820,498 A 10/1998 Maleski
6,322,464 B1 11/2001 Sestak
7,311,622 B1 * 12/2007 Futtere ..... F42B 6/08 473/583
8,337,341 B1 12/2012 Huang
8,668,606 B1 * 3/2014 Gryspeerd ..... F42B 6/08 473/582
8,678,960 B2 * 3/2014 Bierfreund ..... F42B 6/08 473/583

* cited by examiner

*Primary Examiner* — John Ricci
(74) *Attorney, Agent, or Firm* — Donald J. Ersler

(57) ABSTRACT

An expanding broadhead preferably includes a shank base, a razor tip, at least one expanding barb unit, a rear retention ring and a front retention ring. An arrow shaft shank extends from one end of the shank base and a tip slot formed in an opposing end to receive the razor tip. Each expanding barb unit preferably includes two barb elements that extend from a base ring. Each barb element preferably includes a lengthwise barb base, a first set of opposing barbs, a second set of opposing barbs and opposing bulges. The two lengthwise barb bases are bent to obtuse angles. The base ring of the expanding barb unit is bent into a substantially semi-circular shape. The rear retention ring is forced over the base ring to retain thereof on the base shank. The front retention ring is stretched and placed over the at least two barb elements.

20 Claims, 5 Drawing Sheets

EXPANDING BROADHEAD

BACKGROUND OF THE INVENTION

1. Field of the Invention

The present invention relates generally to archery and more specifically to an expanding broadhead, which has less weight and complexity than that of the prior art.

2. Discussion of the Prior Art

U.S. Pat. No. 5,090,709 to Johnson discloses an arrowhead with extendable blades. U.S. Pat. No. 5,820,498 to Maleski discloses a broadhead for an arrow having expanding cutting blades and method of assembling same. U.S. Pat. No. 6,322,464 to Sestak discloses a hunting arrowhead with broadhead and extendable blades.

Accordingly, there is a clearly felt need in the art for an expanding broadhead, which has less weight and complexity than that of the prior art.

SUMMARY OF THE INVENTION

The present invention provides an expanding broadhead, which has less weight and complexity than that of the prior art. The expanding broadhead preferably includes a shank base, a razor tip, at least one expanding barb unit, a rear retention ring and a front retention ring. The shank base includes a pointed end formed on one end and an arrow shaft shank extending from a distal end thereof. A tip slot is formed in the pointed end to receive the razor tip. At least two barb element slots are formed from substantially the distal end to the one end of the shank base. A width of each barb element slot is sized to receive a width of a barb element. A preferable embodiment of the arrow shaft shank is disclosed in full detail in U.S. Pat. No. 8,337,341 to Huang, which is hereby incorporated by reference in its entirety. However, an arrow shaft shank, which is received by a typical arrow outsert or arrow insert may also be used. The arrow shaft shank preferably includes a neck portion and a threaded portion. The threaded portion extends from a distal end of the neck portion. A first o-ring groove is formed on a first end of the neck portion and a second o-ring groove is formed on a second end of the neck portion. The first and second o-ring grooves are sized to receive first and second o-rings. The razor tip includes a substantially triangular shape. Two opposing edges of the razor tip are sharpened into blades.

Each expanding barb unit preferably includes two barb elements and a base ring. The two barb elements extend from the base ring. Each barb element preferably includes a lengthwise barb base, a first set of opposing barbs, a second set of opposing barbs and opposing bulges. The opposing bulges are formed about $\frac{1}{3}^{rd}$ of a distance from the base ring from opposing sides of the lengthwise barb base. The first set of opposing barbs are formed on a distal end of the lengthwise barb base. A retainer space is created between the first set of opposing barbs and the second set of opposing barbs to allow placement of the front retention ring.

The two lengthwise barb bases are bent backwards and flat at substantially a middle of the two opposing bulges. The two lengthwise barb bases are then bent forward and flat, adjacent the second set of opposing barbs. The base ring of the expanding barb unit is then bent into a substantially semi-circular shape. The two lengthwise barb bases are then slid into the two barb element slots. The rear retention ring includes a flange portion and a cylindrical portion. The cylindrical portion extends from the flange portion. A boss hole is formed through the flange portion to receive a ring boss. The ring boss terminates a distal end of the shank base. An inner perimeter of the cylindrical portion is preferably tapered. An entrance to the inner perimeter is preferably curved, chamfered, tapered or broken. The rear retention ring is forced over the base ring of the at least one expanding barb unit, until the flange portion contacts the distal end of the shank base.

The front retention ring is preferably an o-ring, but other suitable devices may also be used. The front retention ring is stretched and placed over the at least two barb elements in the area of the retainer space. The razor tip is inserted into the tip slot and retained in place with a fastener. The arrow shaft shank is secured in an arrow outsert or arrow insert. In use, an arrow with the expanding broadhead is fired at a game animal. The razor tip passes through the meat of the game animal and a distal end of the barb element contacts the meat. Upon contact with the meat, the barb element unfolds to a substantially perpendicular orientation with an axis of the shank base. The plurality of opposing barbs and bulges act as a plurality of small knives to cut through the meat and kill the game animal.

Accordingly, it is an object of the present invention to provide an expanding broadhead, which has less weight and complexity than that of the prior art.

These and additional objects, advantages, features and benefits of the present invention will become apparent from the following specification.

DETAILED DESCRIPTION OF THE PREFERRED EMBODIMENTS

Figure 1:
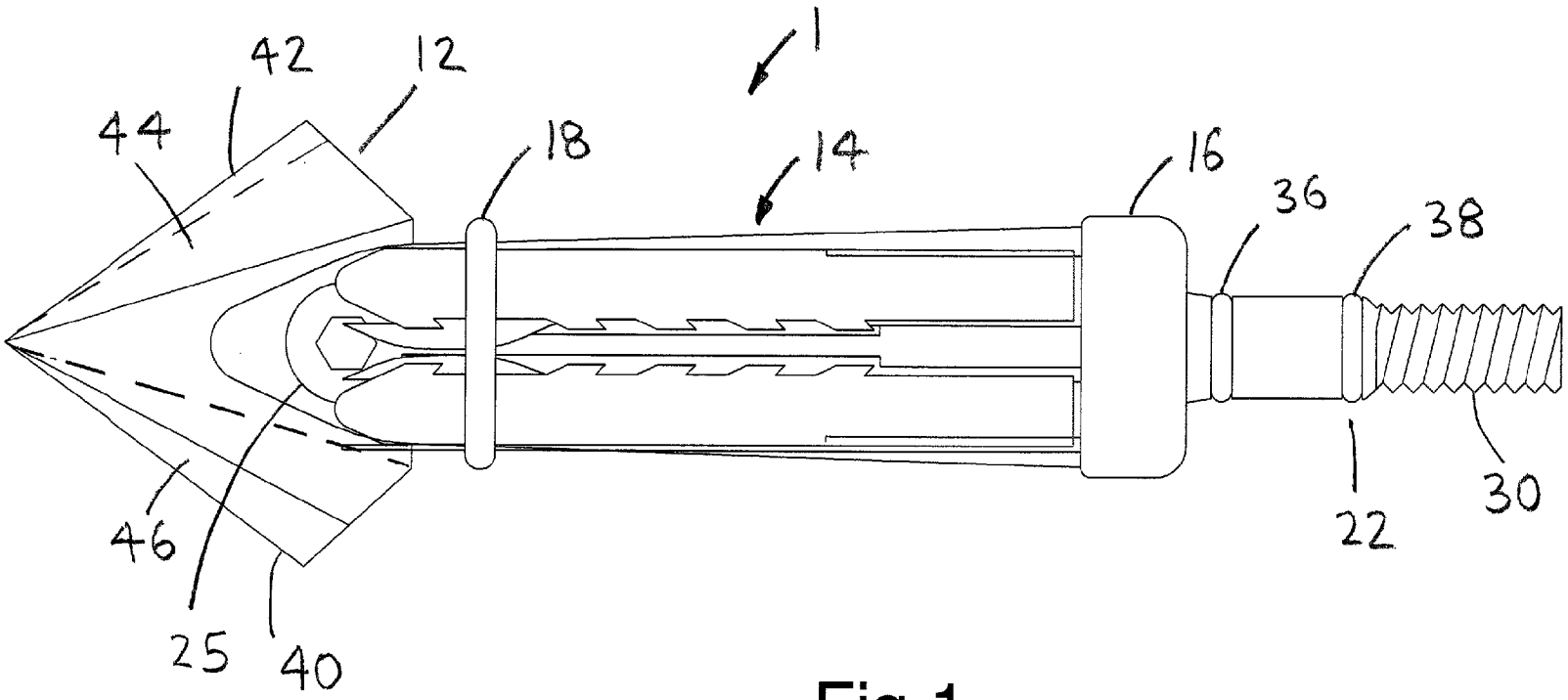
FIG. 1 is a top view of an expanding broadhead in accordance with the present invention.
Figure 2:
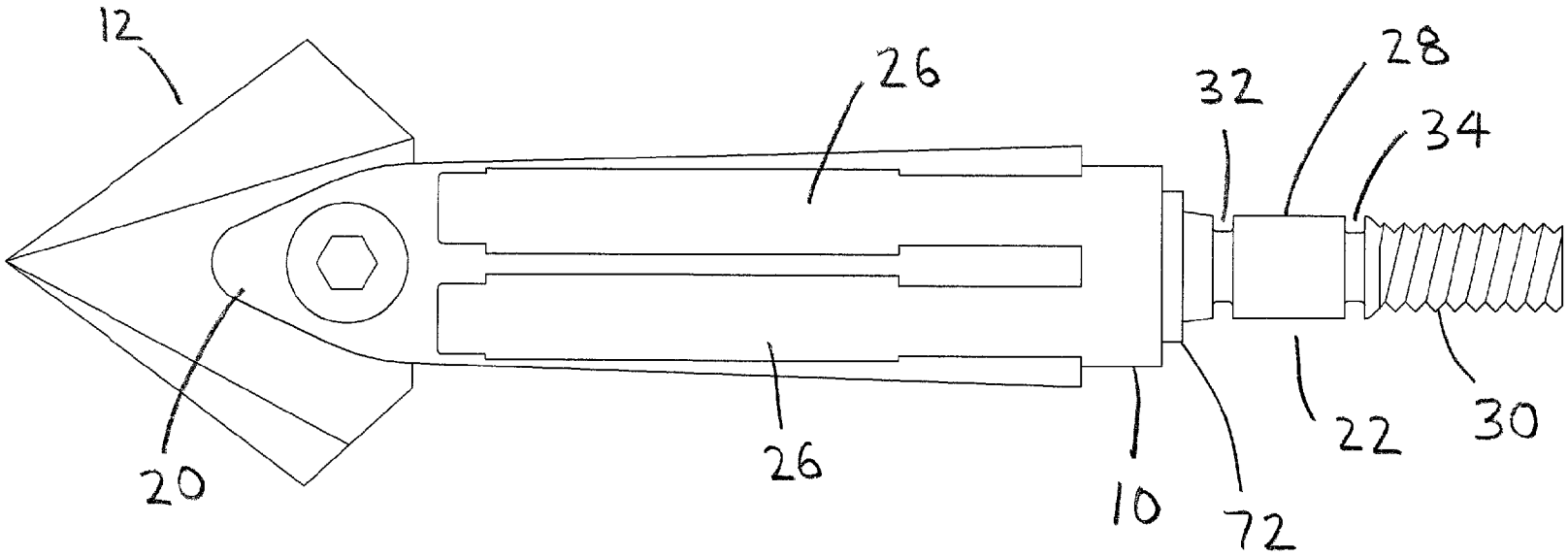
FIG. 2 is a top view of an expanding broadhead without at least one expanding unit and retaining rings in accordance with the present invention.
Figure 3:
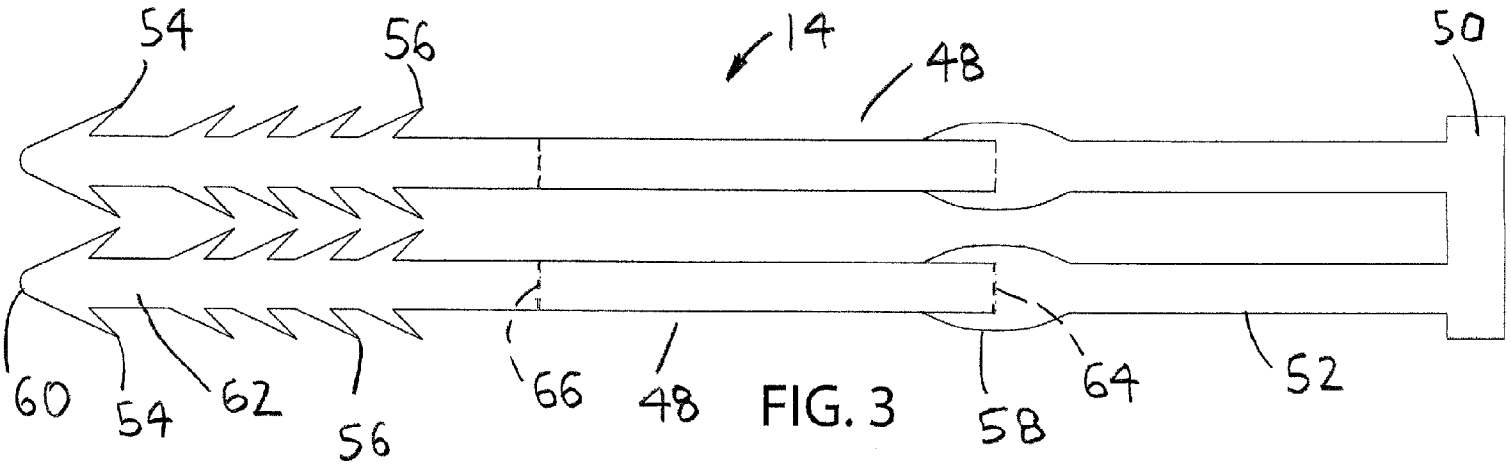
FIG. 3 is a top view of an expanding barb unit of an expanding broadhead in accordance with the present invention.
Figure 4:
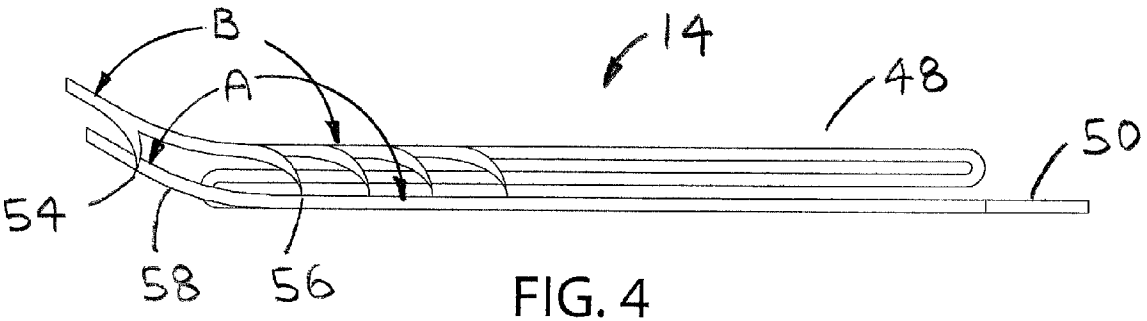
FIG. 4 is a side view of a folded expanding barb unit of an expanding broadhead in accordance with the present invention.
Figure 5:
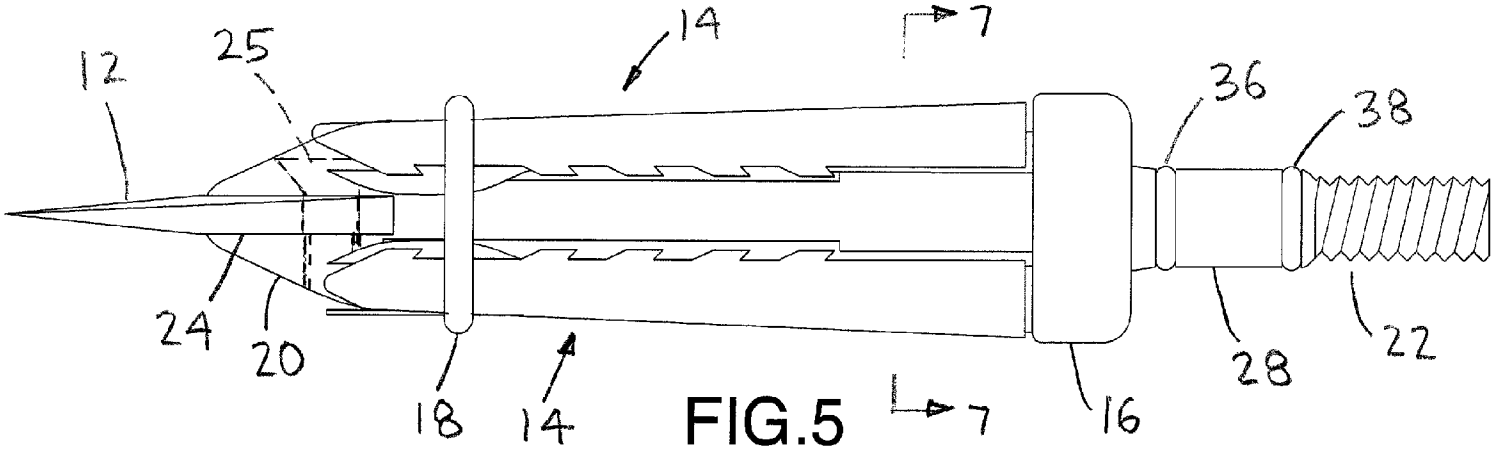
FIG. 5 is an end view of an expanding broadhead in accordance with the present invention.
Figure 7:
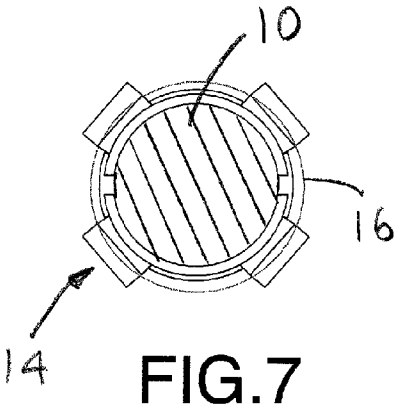
FIG. 7 is a cross sectional view of a base shank and rear retention ring of an expanding broadhead in accordance with the present invention.
Figure 6:
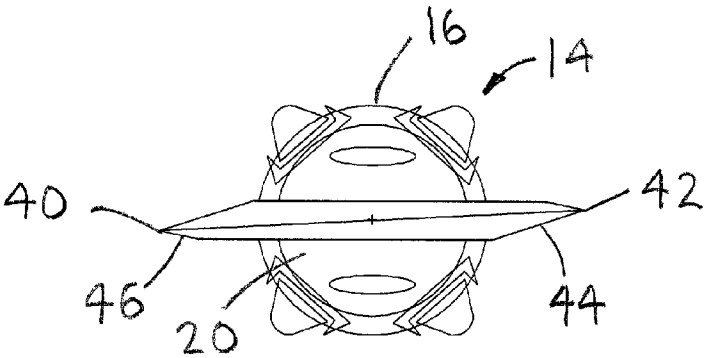
FIG. 6 is an end view of an expanding broadhead in accordance with the present invention.

With reference now to the drawings, and particularly to FIG. 1, there is shown a top view of an expanding broadhead 1. With reference to FIGS. 2-5, the expanding broadhead 1 preferably includes a shank base 10, a razor tip 12, at least one expanding barb unit 14, a rear retention ring 16 and a front retention ring 18. The shank base 10 includes a substantially pointed nose 20 formed on one end and an arrow shaft shank 22 extending from a distal end thereof. A tip slot 24 is formed in the pointed nose 20 to receive the razor tip 12. A fastener 25 is threaded into the pointed nose 20 to retain the razor tip 12 in the tip slot 24. With reference to FIG. 6, at least two barb element slots 26 are formed from substantially the distal end of the shank base 10 to the one end of the shank base 10. A width of each barb element slot 26 is sized to receive a width of a lengthwise barb base 52. A preferable embodiment of the arrow shaft shank 22 is disclosed in full detail in U.S. Pat. No. 8,337,341 to Huang, which is hereby incorporated by reference in its entirety. However, an arrow shaft shank, which is received by a typical arrow outsert or arrow insert may also be used. The arrow shaft shank 22 preferably includes a neck portion 28 and a threaded portion 30. The threaded portion 30 extends from a distal end of the neck portion 28. A first o-ring groove 32 is formed on a first end of the neck portion 28 and a second o-ring groove 34 is formed on a second end of the neck portion 28. The first and second o-ring grooves 32, 34 are sized to receive first and second o-rings 36, 38.

The razor tip 12 includes a substantially triangular shape. Two sharpened edges 40, 42 are formed on opposing sides of the razor tip 12 with a small beveled edge 44 and a large beveled edge 46. The beveled edge 44 is formed on one surface and the beveled edge 46 is formed on an opposing surface of the razor tip 12. Each expanding barb unit 14 preferably includes two barb elements 48 and a base ring 50. The two barb elements 48 extend from the base ring 50. Each barb element 48 preferably includes a lengthwise barb base 52, a first set of opposing barbs 54, a second set of opposing barbs 56, opposing bulges 58 and a point 60. The opposing bulges 58 are formed about $1/3^{rd}$ of a distance from the base ring 50 and extend from opposing sides of the lengthwise barb base 52. The point 60 is formed on a distal end of the lengthwise barb base 52. The first set of opposing barbs 54 extend from opposing sides of the point 60. A retainer space 62 is created between the first set of opposing barbs 54 and the second set of opposing barbs 56 to allow placement of the front retention ring 18. The second set of opposing barbs 56 extend from opposing sides of the lengthwise barb base 52.

The two lengthwise barb bases 48 are bent backwards and flat on a first bend line 64 at substantially a middle of the two opposing bulges 58. The two lengthwise barb bases 48 are then bent forward and flat at a second bend line 66, adjacent the second set of opposing barbs 56. A distal end of the two opposing bulges 58 are preferably bent upward to an angle A. A distal end of the first set of opposing barbs are preferably bent upward to an angle B. It is preferable that angles A & B have a value of 150 degrees. The first and second set of opposing barbs are preferably bent downward relative to the two lengthwise barb bases 48. The base ring 50 of the expanding barb unit 14 is then bent into a substantially semi-circular shape to match of an outer diameter of a distal end of the shank base 10. The two lengthwise barb bases 52 are then slid into the two barb element slots 26. The rear retention ring 16 includes a flange portion 68 and a cylindrical portion 70. The cylindrical portion 70 extends from the flange portion 68. A boss hole is formed through the flange portion to receive a ring boss 72. The ring boss 72 terminates the distal end of the shank base 10. An inner perimeter of the cylindrical portion 70 is preferably tapered. An entrance to the inner perimeter is preferably curved, chamfered, tapered or broken. The rear retention ring 16 is forced over the base ring 50 of the at least one expanding barb unit 14, until the flange portion 68 contacts the distal end of the shank base 10.

The front retention ring 18 is preferably an o-ring, but other suitable devices may also be used. The front retention ring 18 is stretched and placed over the at least two barb elements 48 in the area of the retainer space 62. The razor tip 12 is inserted into the tip slot 24 and retained in place with the fastener 25. The arrow shaft shank 22 is secured in an arrow outsert or arrow insert. In use, an arrow shaft (not shown) with the expanding broadhead 1 is fired at a game animal. The razor tip 12 passes through the meat of the game animal and the point 60 of the barb element 48 contacts the meat. Upon contact with the meat, the barb element 48 cuts the front retention ring 18 and unfolds to a substantially perpendicular orientation with an axis of the shank base 10. The plurality of opposing barbs 54, 56 and the bulges 58 act as a plurality of small knives to cut through the meat and kill the game animal.

Figure 8:
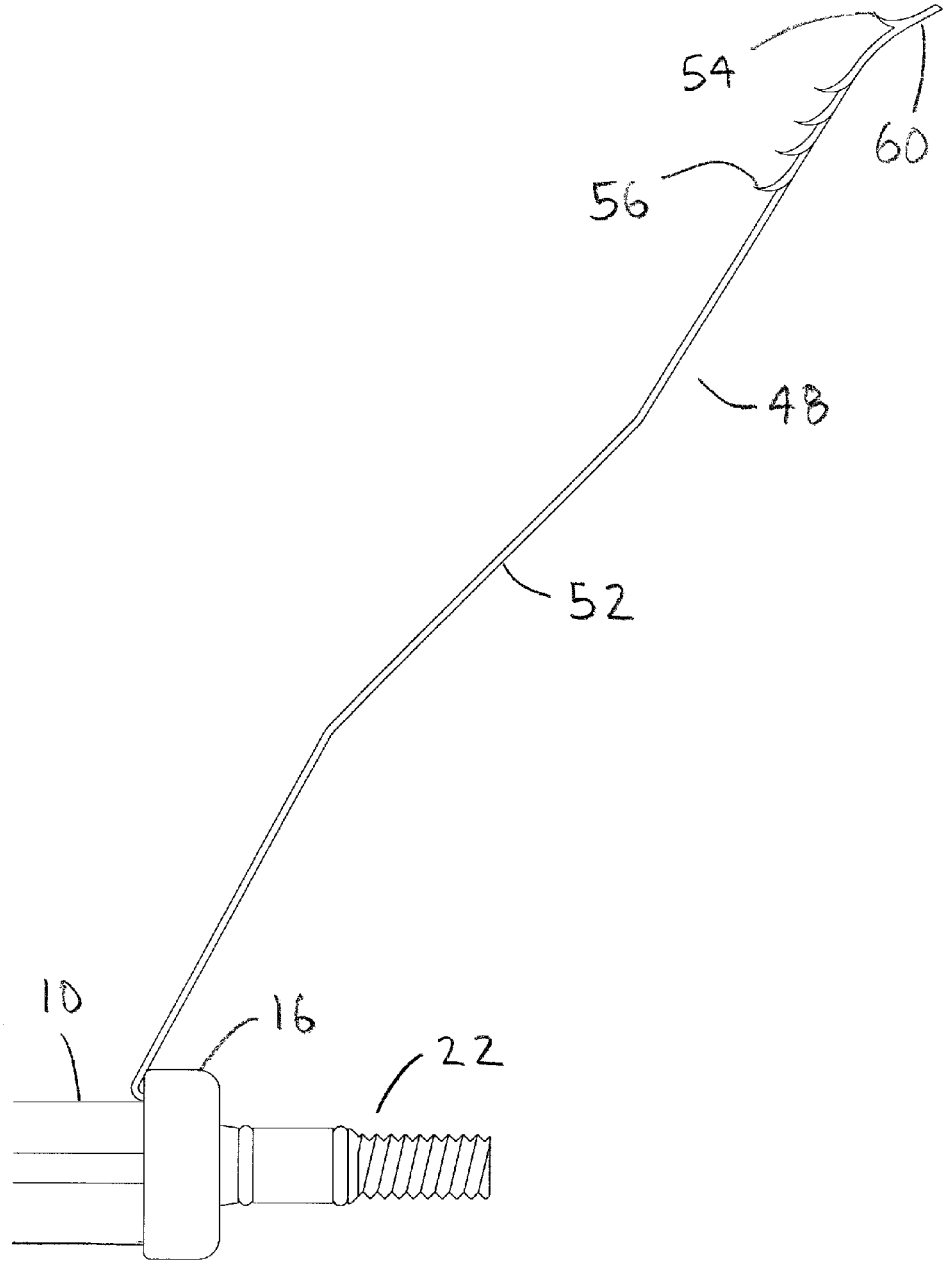
FIG. 8 is a side view of an unfolded barb element and a rear portion of a shank base, which occurs after a point of a first set of opposing barbs strikes an animal of an expanding broadhead in accordance with the present invention.

FIG. 8 illustrates a side view of a single unfolded barb element 48 and a rear portion of a shank base 10. The point 60 of the unfolded barb element strikes a game animal, which causes the barb element 48 to unfold as illustrated in FIG. 8. The unfolded barb element 48 with the first set of opposing barbs 54, the second set of opposing barbs 58 and the opposing bulges 58 cut into the meat of the game animal.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. An expanding broadhead comprising:

a shank base having a pointed nose formed on one end, an arrow shaft shank extending from an opposing end thereof;

at least one expanding barb unit includes at least two lengthwise barb bases, at least one set of opposing barbs extends from each one of said two lengthwise barb bases; and a retention device for retaining said at least one expanding barb unit on said shank base.

2. The expanding broadhead of claim 1, further comprising:

a razor tip is retained in said one end of said shank base.

3. The expanding broadhead of claim 2 wherein:

said razor tip includes a substantially triangular shape.

4. The expanding broadhead of claim 1 wherein:

opposing bulges are formed about $1/3^{rd}$ of a distance along a length of at least one of said at least two lengthwise barb bases.

5. The expanding broadhead of claim 4 wherein:

at least one of said at least two lengthwise barb bases is bent backwards at substantially a middle of said opposing bulges, said lengthwise barb base is bent forward about ⅔rds a distance along a length of said lengthwise barb base.

6. The expanding broadhead of claim 1 wherein:

said at least two lengthwise barb bases extend from a base ring.

7. The expanding broadhead of claim 6 wherein:

said retention device includes a cylindrical portion that extends from a flange portion, an inner perimeter of said cylindrical portion is tapered, wherein said retention device is forced over said base ring and said shank base.

8. An expanding broadhead comprising:

a shank base having a pointed nose retained on one end, an arrow shaft shank extending from an opposing end thereof, at least two barb slots are formed in said shank base;

at least one expanding barb unit includes at least two lengthwise barb bases, at least one set of opposing barbs extends from each one of said at least two lengthwise barb bases, said at least two barb slots are sized to receive said at least two lengthwise barb bases; and a retention device for retaining said at least one expanding barb unit on said shank base.

9. The expanding broadhead of claim 8, further comprising:

a razor tip is retained in said one end of said shank base.

10. The expanding broadhead of claim 9 wherein:

said razor tip includes a substantially triangular shape.

11. The expanding broadhead of claim 8 wherein:

opposing bulges are formed about ⅓$^{rd}$ of a distance along a length of each one of said at least two lengthwise barb bases.

12. The expanding broadhead of claim 11 wherein:

at least one of said at least two lengthwise barb bases is bent backwards at substantially a middle of said opposing bulges, said lengthwise barb base is bent forward about ⅔rds a distance along a length of said lengthwise barb base.

13. The expanding broadhead of claim 8 wherein:

said at least two lengthwise barb bases extend from a base ring.

14. The expanding broadhead of claim 13 wherein:

said retention device includes a cylindrical portion that extends from a flange portion, an inner perimeter of said cylindrical portion is tapered, wherein said retention device is forced over said base ring and said shank base.

15. An expanding broadhead comprising:

a shank base having a pointed nose retained on one end, an arrow shaft shank extending from an opposing end thereof;

at least one expanding barb unit includes at least two lengthwise barb bases, at least one set of opposing barbs extends from each one of said at least two lengthwise barb bases; and a rear retention device for retaining said at least one expanding barb unit on said shank base; and a front retention device for releasably retaining a distal end of said at least two barb elements relative to said shank base.

16. The expanding broadhead of claim 15, further comprising:

a razor tip is retained in said one end of said shank base.

17. The expanding broadhead of claim 16 wherein:

said razor tip includes a substantially triangular shape.

18. The expanding broadhead of claim 15 wherein:

opposing bulges are formed about ⅓$^{rd}$ of a distance along a length of said lengthwise barb base.

19. The expanding broadhead of claim 18 wherein:

at least one of said at least two lengthwise barb bases is bent backwards at substantially a middle of said opposing bulges, said lengthwise barb base is bent forward about ⅔rds a distance along a length of said lengthwise barb base.

20. The expanding broadhead of claim 15 wherein:

said front retention device is an o-ring.

* * * * *